US008534537B2

(12) United States Patent
House

(10) Patent No.: US 8,534,537 B2
(45) Date of Patent: Sep. 17, 2013

(54) CARTON WITH OPENER

(75) Inventor: Richard F. House, Geneva, IL (US)

(73) Assignee: Graphic Packaging International, Inc., Marietta, GA (US)

( * ) Notice: Subject to any disclaimer, the term of this patent is extended or adjusted under 35 U.S.C. 154(b) by 585 days.

(21) Appl. No.: 12/612,780

(22) Filed: Nov. 5, 2009

(65) Prior Publication Data

US 2010/0108749 A1 May 6, 2010

Related U.S. Application Data

(60) Provisional application No. 61/198,392, filed on Nov. 5, 2008.

(51) Int. Cl.
*B65D 5/46* (2006.01)
*B65D 5/54* (2006.01)
*B31B 1/14* (2006.01)

(52) U.S. Cl.
USPC ..... 229/117.18; 229/200; 493/63

(58) Field of Classification Search
USPC ..... 229/117.18, 200, 110, 902, 117.09, 229/117.11, 117.23, 150; 493/63; 206/736, 206/746
See application file for complete search history.

(56) References Cited

U.S. PATENT DOCUMENTS 1,947,865 A * 2/1934 Marsh ..... 229/230
2,000,210 A * 5/1935 Bayless ..... 229/110
2,126,106 A * 8/1938 Goldberg ..... 206/443
2,923,455 A * 2/1960 Tingley ..... 229/117.13
2,984,401 A * 5/1961 Herkender ..... 229/110
3,981,434 A 9/1976 Ramich
4,314,643 A 2/1982 Forbes, Jr.
4,746,019 A 5/1988 Prater
4,768,703 A 9/1988 Sosler et al.
4,773,542 A 9/1988 Schillinger et al.
5,014,855 A 5/1991 Roccaforte
5,027,748 A 7/1991 Wolak
5,193,740 A * 3/1993 Newborough et al. ..... 229/242

(Continued)

FOREIGN PATENT DOCUMENTS

EP 406556 A1 1/1991
JP 11-321848 A 11/1999

(Continued)

OTHER PUBLICATIONS

International Search Report and Written Opinion, PCT/US2009/063345, mailed Jul. 5, 2010.

*Primary Examiner* — Gary Elkins
*Assistant Examiner* — Christopher Demeree
(74) *Attorney, Agent, or Firm* — Womble Carlyle Sandridge & Rice, LLP

(57) ABSTRACT

A blank, carton, or package that includes a dispensing flap is described. The dispensing flap is formed in an end flap and covers an opening formed in another end flap when the carton is formed. The dispensing flap is detachable along a pattern of tear lines and the dispensing flap can be hinged to expose the opening and allow contents of the carton to be dispensed from the opening. A tear tab can be included to initiate detachment of the dispensing flap along the tear line pattern. A hanging flap can be provided to hang the carton from a vertical surface. End flaps and tuck-in flaps can be provided at a first end and a second end of the blank to secure the ends of the carton.

27 Claims, 5 Drawing Sheets

(56) References Cited

U.S. PATENT DOCUMENTS

| | | | | |
|---|---|---|---|---|
| 5,265,799 | A | 11/1993 | Stone | |
| 5,314,114 | A | 5/1994 | Stone | |
| 5,322,215 | A | 6/1994 | Roccaforte | |
| 5,505,374 | A | 4/1996 | Stone | |
| 5,511,722 | A | 4/1996 | Dixon | |
| 5,673,849 | A | 10/1997 | Stone | |
| 5,749,462 | A | 5/1998 | Houghton | |
| 5,775,576 | A | 7/1998 | Stone | |
| 5,788,102 | A | 8/1998 | Hall et al. | |
| 5,873,516 | A | 2/1999 | Boggs | |
| 5,924,626 | A | 7/1999 | Whitnell | |
| 6,079,616 | A * | 6/2000 | Chinks et al. | 229/101 |
| 6,196,448 | B1 * | 3/2001 | Correll | 229/103.11 |
| 6,869,009 | B2 | 3/2005 | Sutherland et al. | |
| 6,913,190 | B2 | 7/2005 | Ruhbusch et al. | |
| 6,969,196 | B2 | 11/2005 | Woodham et al. | |
| 6,979,482 | B2 | 12/2005 | Hartzell et al. | |
| 7,090,904 | B2 | 8/2006 | Hartzell et al. | |
| 7,544,403 | B2 | 6/2009 | Hartzell et al. | |
| 7,549,269 | B2 | 6/2009 | Woodham et al. | |
| 7,669,755 | B2 | 3/2010 | Smalley | |
| 7,699,214 | B2 | 4/2010 | Mestre et al. | |
| 7,703,665 | B2 | 4/2010 | McGowan | |
| 2004/0091648 | A1 | 5/2004 | Hartzell et al. | |
| 2004/0175060 | A1 | 9/2004 | Woodham et al. | |
| 2004/0228547 | A1 | 11/2004 | Hartzell et al. | |
| 2005/0006447 | A1 | 1/2005 | Caroli | |
| 2006/0053746 | A1 | 3/2006 | Woodham et al. | |
| 2006/0053752 | A1 | 3/2006 | Woodham et al. | |
| 2006/0073292 | A1 | 4/2006 | Hartzell et al. | |
| 2007/0119914 | A1 | 5/2007 | Mestre et al. | |
| 2007/0235511 | A1 | 10/2007 | Fitzwater et al. | |
| 2010/0019022 | A1 | 1/2010 | Ryan et al. | |
| 2011/0049143 | A1 | 3/2011 | Woodham et al. | |

FOREIGN PATENT DOCUMENTS

| | | | |
|---|---|---|---|
| JP | 2000-085775 | A | 3/2000 |
| JP | 2000-507531 | A | 6/2000 |
| JP | 2005-088975 | A | 4/2005 |
| WO | WO 97/36792 | | 10/1997 |

* cited by examiner

CARTON WITH OPENER

CROSS-REFERENCE TO RELATED APPLICATION

This application claims the benefit of U.S. Provisional Application No. 61/198,392, which was filed on Nov. 5, 2008.

INCORPORATION BY REFERENCE

U.S. Provisional Application No. 61/198,392, which was filed on Nov. 5, 2008, is hereby incorporated by reference for all purposes as if presented herein in its entirety.

BACKGROUND OF THE DISCLOSURE

Cartons are useful for holding and transporting articles. In order to facilitate dispensing of articles from a carton, it is beneficial to form a dispenser with a portion of the carton.

SUMMARY OF THE DISCLOSURE

The present disclosure generally relates to blanks, packages, or cartons for holding and/or dispensing product.

In one aspect, the present invention includes a blank with a first side panel connected along a first fold line to a second side panel, the second side panel is connected along a second fold line to a third side panel, the third side panel is connected along a third fold line to a fourth side panel, the fourth side panel is connected along a fourth fold line to a fifth side panel, the fifth side panel is connected along a fifth fold line to a sixth side panel, and the sixth side panel is connected along a sixth fold line to an adhesive panel. The blank includes end flaps connected along a first transverse fold line to a first end of the blank and along a second transverse fold line to a second end of the blank. The end flaps include a first end flap connected along the first transverse fold line and a second end flap connected along the first transverse fold line. The first end flap includes a tear line pattern that defines a dispenser. The tear line pattern extends across the first transverse fold line. The second end flap includes an opening. The first end flap overlaps the second end flap with the dispenser overlapping the opening in a carton formed from the blank.

A hanging end flap can be connected along a hanging fold line to the first end flap. The dispensing end flap can be connected along the first transverse fold line to the third side panel, and the tear line pattern can extend into the third side panel. The tear line pattern generally forms a tear tab in the third side panel. The tear line pattern can be substantially continuous and the dispenser can include sections of the third side panel and of the first end flap. The second end flap can be connected along the first transverse fold line to the sixth side panel. A third end flap can be attached along the first transverse fold line to the first side panel and a fourth end flap can be attached along the first transverse fold line to the fifth side panel. A fifth end flap can be connected along the second transverse fold line to the first side panel, a sixth end flap can be connected along the second transverse fold line to the third side panel, a seventh end flap can be connected along the second transverse fold line to the fifth side panel, and an eighth end flap can be connected along the second transverse fold line to the sixth side panel. The second end flap also can include at least one tuck-in flap capable of securing the second end flap in place in the carton formed from the blank. A projection can be provided adjacent the second transverse fold line, with the projection configured to form a stand to help support the carton formed from the blank in an upright configuration.

In another aspect of the present invention, a carton is provided. The carton includes a first side panel connected along a first fold line to a second side panel, the second side panel is connected along a second fold line to a third side panel, the third side panel is connected along a third fold line to a fourth side panel, the fourth side panel is connected along a fourth fold line to a fifth side panel, the fifth side panel is connected along a fifth fold line to a sixth side panel, a first end panel is connected at a first end of the first side panel, the second side panel, the third side panel, the fourth side panel, the fifth side panel, and the sixth side panel, and a second end panel is connected at a second end of the first side panel, the second side panel, the third side panel, the fourth side panel, the fifth side panel, and the sixth side panel. A tear line pattern is provided in the carton and defines a dispensing flap, with the tear line pattern extending from the first end panel into the third side panel. An end flap is connected to the sixth side panel, is disposed under the dispensing flap of the carton, and includes an opening. A hanging flap is connected along a hanging fold line to the first end panel. The dispensing flap is detachable along the tear line pattern and is capable of being hinged about the hanging fold line to allow the contents of the carton to be dispensed through the opening. The hanging flap generally is capable of being hinged about the hanging fold line to be disposed approximately perpendicular the first end panel. The hanging flap can include a hook opening that can be used to hang the carton from the hanging flap. A projection can be provided at the second end, with the projection is configured to form a stand to support the carton in an upright configuration.

In still another aspect, the invention includes a method of dispensing that includes providing a carton. The carton including a first side panel connected along a first fold line to a second side panel, the second side panel is connected along a second fold line to a third side panel, the third side panel is connected along a third fold line to a fourth side panel, the fourth side panel is connected along a fourth fold line to a fifth side panel, the fifth side panel is connected along a fifth fold line to a sixth side panel, a first end panel is connected at a first end of the first side panel, the second side panel, the third side panel, the fourth side panel, the fifth side panel, and the sixth side panel, and a second end panel is connected at a second end of the first side panel, the second side panel, the third side panel, the fourth side panel, the fifth side panel, and the sixth side panel. A tear line pattern also can be provided in the carton and defines a dispensing flap, with the tear line pattern extending from the first end panel into the third side panel. An end flap is connected to the sixth side panel, is disposed under the dispensing flap of the carton, and includes an opening. The dispensing flap is detachable along the tear line pattern and is capable of being hinged about the hanging fold line to allow contents to be dispensed through the opening from the carton. The method also includes separating the dispensing flap from a remainder portion of the carton by tearing along the tear line pattern and dispensing contents from the carton through the opening. A hanging flap can be connected along a hanging fold line to the first end panel. The separation of the dispensing flap along the tear line pattern can be initiated by a tear tab. The tear tab can be disposed in the third side panel. The separation of the dispensing flap along the tear line pattern can include hinging the dispensing flap along the hanging fold line in a first direction to expose the opening. The method can further include hinging the dispensing flap to close the carton after dispensing. The method can further include hinging the hanging flap about the hanging fold line to dispose the hanging flap approximately perpendicular the first end panel. Further, the hanging flap can include a hook opening that can be used to hang the carton from the hanging flap. A projection can be included at the second end, with the projection configured to form a stand to support the carton in an upright configuration.

Those skilled in the art will appreciate the above stated advantages and other advantages and benefits of various additional embodiments upon reading the following detailed description of the exemplary embodiments with reference to the below listed drawing figures.

According to common practice, the various features of the drawings discussed below are not necessarily drawn to scale. Dimensions of various features and elements in the drawings may be expanded or reduced to illustrate more clearly the embodiments of the disclosure.

BRIEF DESCRIPTION OF THE DRAWINGS

Corresponding parts are designated by corresponding reference numbers throughout the drawings.

DETAILED DESCRIPTION OF THE EXEMPLARY EMBODIMENTS

Figure 1:
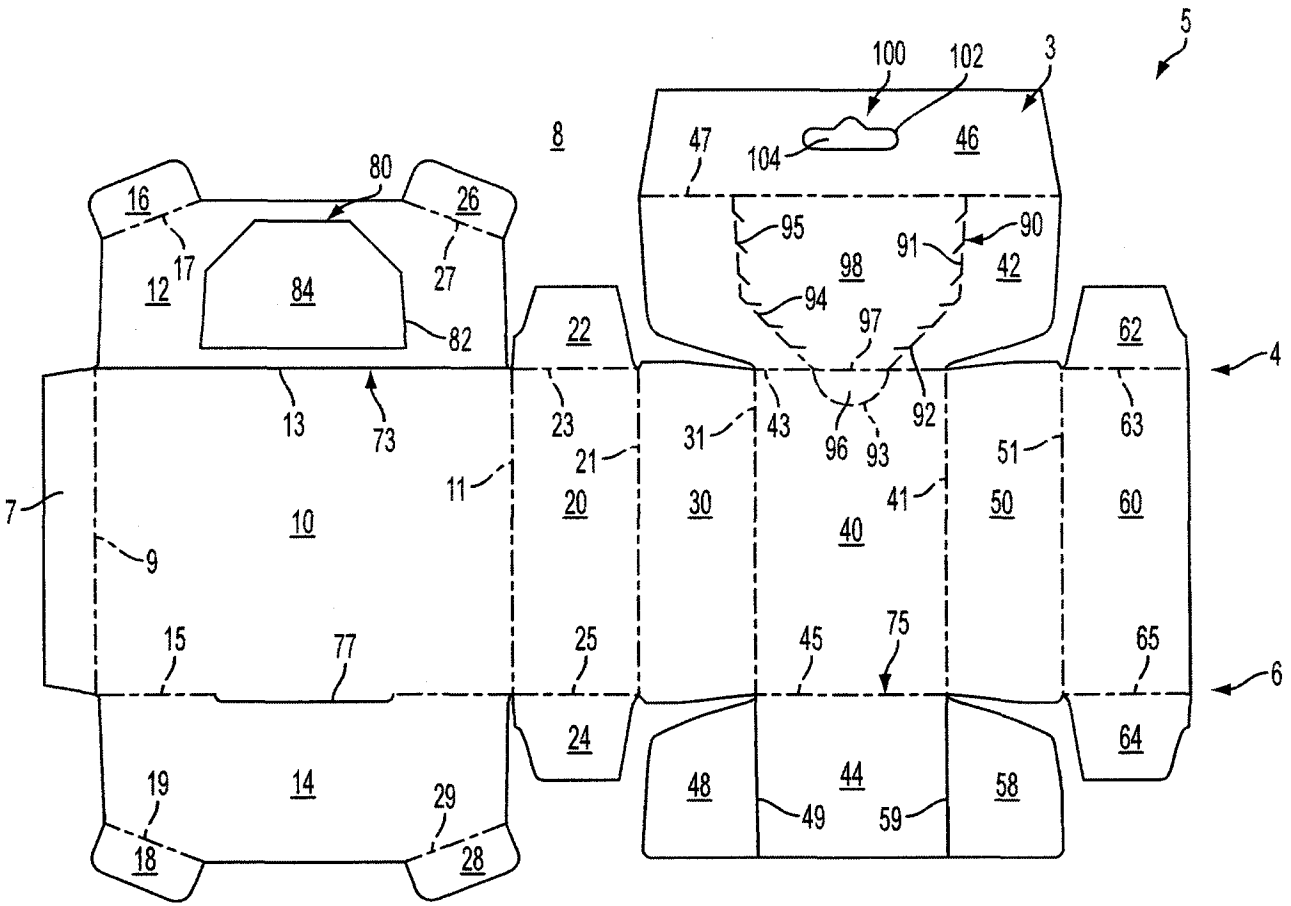
FIG. 1 is a plan view of a carton blank according to one embodiment.

This disclosure generally relates to cartons suitable for storing and dispensing contents or articles, and methods of erecting such cartons from a carton blank. For purposes of illustration and not limitation, the detailed description below describes several embodiments of the invention within the context of a carton with an opener for dispensing contents or articles from the carton. Further, references herein to "end," "side," "front," "rear," "bottom," and "top" refer to orientations or positions of elements when the carton is erected and disposed in an upright orientation. The terms "upper," "lower," "vertical," "horizontal," and "oblique," and any variations thereof, generally refer to the location and/or orientation of an element or line with respect to a drawing figure in which it appears. Reference characters shared among the various embodiments disclosed herein indicate similar parts.

FIG. 1 illustrates an outside facing surface 3 of a carton blank 5 from which a carton 200 (FIGS. 2-8) can be erected. The blank 5 includes a back panel 10, a first side panel 20, a first side corner panel 30, a front panel 40, a second side corner panel 50, a second side panel 60, and an adhesive panel 7. Adhesive panel 7 is foldably connected along fold line 9 to the panel 10, the panel 10 is foldably connected along fold line 11 to panel 20, panel 20 is foldably connected along fold line 21 to panel 30, panel 30 is foldably connected along fold line 31 to panel 40, panel 40 is foldably connected along fold line 41 to panel 50, and panel 50 is foldably connected along fold line 51 to panel 60. End flap 12 is connected along a fold line 13 to a first end 4 of panel 10. Tuck-in flap 16 is foldably connected along a fold line 17 to end flap 12 and tuck-in flap 26 is foldably connected along a fold line 27 to end flap 12. End flap 14 is foldably connected along a fold line 15 to a second end 6 of panel 10. Tuck-in flap 18 is foldably connected along a fold line 19 to end flap 14 and tuck-in flap 28 is foldably connected to end flap 14 along a fold line 29. A projection 77 extends slightly below fold line 15 and is configured to form a stand or similar formation to help support carton 200 in an upright configuration, such as when carton 200 is disposed on a surface, such as a shelf. A central cutout or opening 80 is also provided in end flap 12. While opening 80 could be covered by a flap (not shown), generally, opening 80 is defined by a perimeter 82 surrounding a void 84. The opening 80 is shown in FIG. 1 with an irregular, hexagonal shape, though other shapes are within the scope of the invention. In lieu of "panels," the surfaces of carton 200 formed from the blank 5 can be referred to as "sides."

End flap 22 is foldably connected along fold line 23 at the first end 4 of panel 20 and end flap 24 is foldably connected along fold line 25 at the second end 6 of panel 20. End flap 42 is foldably connected along fold line 43 at the first end 4 of panel 40 and end flap 44 is foldably connected along fold line 45 at the second end 6 of panel 40. A hanging flap 46 is foldably connected along a fold line 47 to end flap 42. Hanging flap 46 is shown with an optional hook portion 100. Hook portion 100 is generally defined by a perimeter 102 surrounding an opening 104. Optionally, opening 104 can be covered with a flap or other cutout. In use, opening 104 receives an attachment element (not shown) such as, for example, a screw, nail, pin, hook, etc., for hanging the carton 200, such as from a support wall or other structure. The hanging flap 46 is shown as being generally trapezoidal in shape, but should not be limited to such shape. End flap 44 optionally can be divided into sections by fold lines, such as section 48 connected to the first end 4 of panel 60, and end flap 64 is foldably connected along fold line 65 to the second end 6 of panel 60. Fold lines 13, 15, 23, 25, 43, 45, 63, 65 are generally transverse to fold lines 9, 11, 21, 31, 41, 51, 61. One or more of fold lines 13, 23, 43, 63 could be replaced by a single fold line, such as indicated at 73, and one or more of fold lines. Fold lines 15, 25, 45, 65 could be replaced by a single fold line, such as indicated at 75. End flaps 12, 14, 22, 24, 42, 44, 62, 64 generally extend in a direction away from respective fold lines 13, 15, 23, 25, 43, 45, 63, and/or 65 toward periphery 8 of the blank.

A dispensing feature 90 is shown in FIG. 1 in end flap 42 and panel 40. Specifically, the dispensing feature 90 is defined by a pattern of tear lines, including tear lines 91, 92, 93, 94, and 95. Tear lines 91 and 95 extend in a generally perpendicular direction from fold line 47 toward fold line 43. Tear line 91 intersects with tear line 92, which extends in a generally oblique direction to a first intersection with fold line 43. Tear line 95 intersects with tear line 94, which extends in a generally oblique direction to a second intersection with fold line 43. The first intersection and the second intersection being spaced apart approximately by a width of a flap or tear tab 96. Flap 96 is defined along fold line 43 by a fold line 97 (which is generally collinear with fold line 43) and by tear line 93. The tear tab 96 functions generally to provide an opening assistance device for separating dispensing panel 98 along the tear line pattern to allow access to opening 80, and to the interior of the carton 200. Tear line 93 extends into or along panel 40 in a generally arcuate manner from the first intersection to the second intersection. Generally, tear lines 91, 92, 93, 94, and 95 will connect to extend in a generally continuous manner, and, along with fold line 97 and fold line 47, define a dispensing panel 98.

To form the blank 5 into carton 200, the panels generally are folded about fold lines to form a sleeve. Next, the end flaps are folded toward the interior of the sleeve to close the ends of the carton. Either the top end or the base end can be enclosed first.

At the base end, end flaps 24 and 64 initially are folded inward, then end flap 14 is folded about fold line 15 and tuck-in flaps 18 and 28 are folded about fold lines 19 and 29, respectively, to tuck into the interior of the carton to secure the base portion in place. Finally, an adhesive can be applied to either end flap 14 or end flap 44, and end flap 44 is folded about fold line 45 to overlap end flap 14.

At the top end, end flaps 22 and 62 initially are folded inward, then end flap 12 is folded about fold line 13 and tuck-in flaps 16 and 26 are folded about fold lines 17 and 27, respectively, to tuck into the interior of the carton to secure the base portion in place. Finally, an adhesive is applied, generally to the non-dispensing sections of end flap 42 or to sections of end flap 12, and end flap 42 is folded about fold line 43 to overlap end flap 12.

FIGS. 2-6 show a carton 200 erected to a closed configuration from the blank 5. An exemplary method of forming the carton 200 will now be described with respect to FIGS. 2-6.

Figure 2:
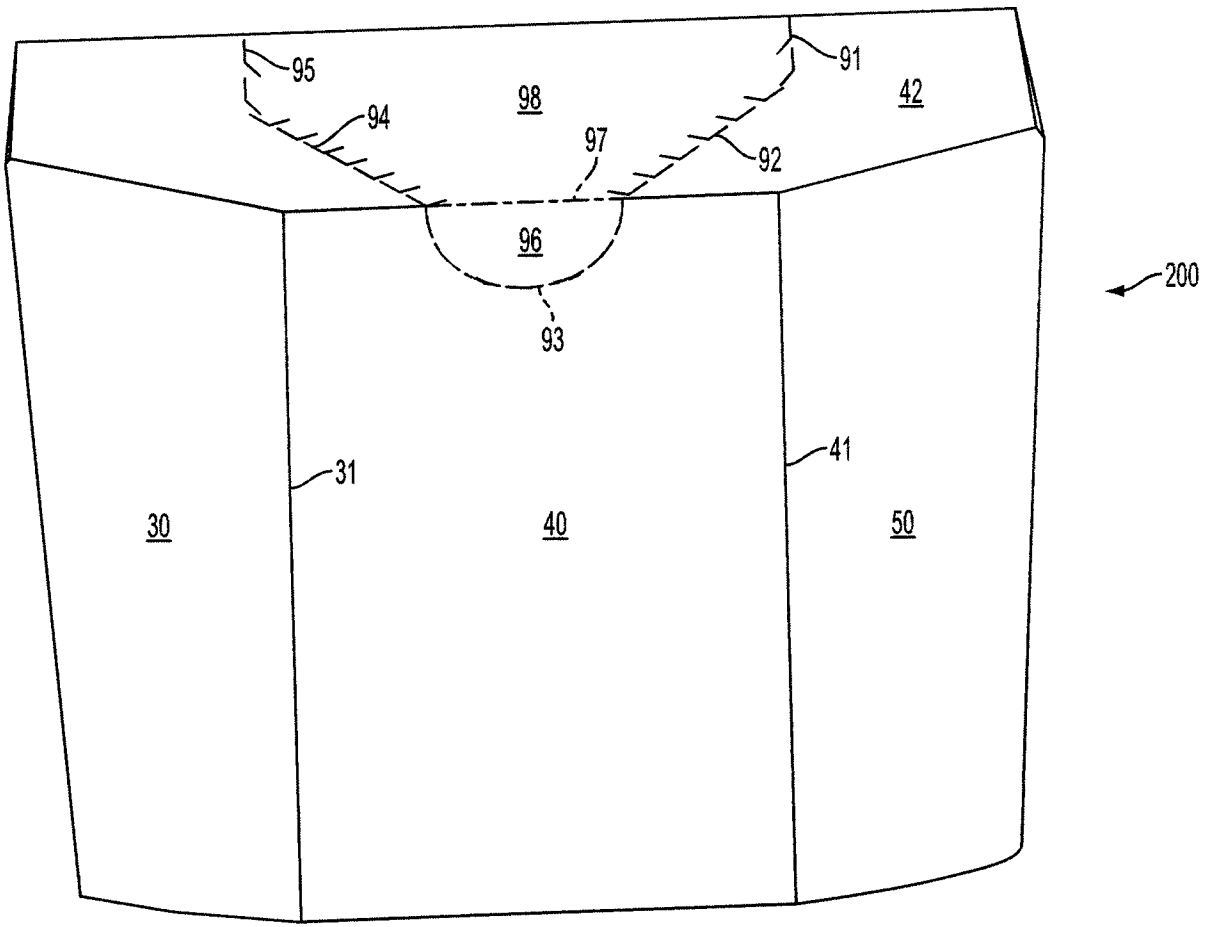
FIG. 2 is a perspective view of a carton erected from the blank of FIG. 1.
Figure 4:
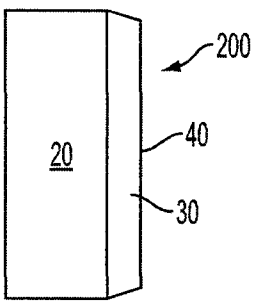
FIG. 4 is a right side view of the carton of FIG. 2.
Figure 6:
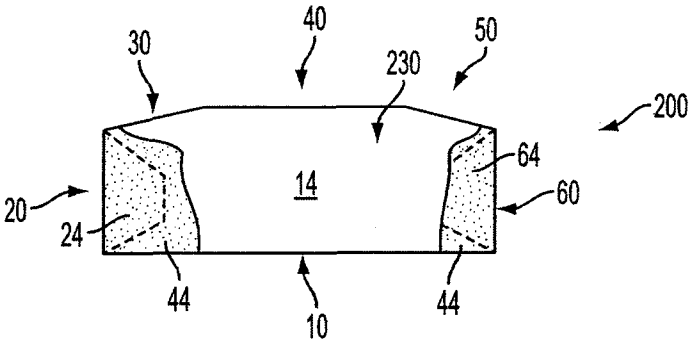
FIG. 6 is a partially cut-away bottom view of the carton of FIG. 2.
Figure 3:
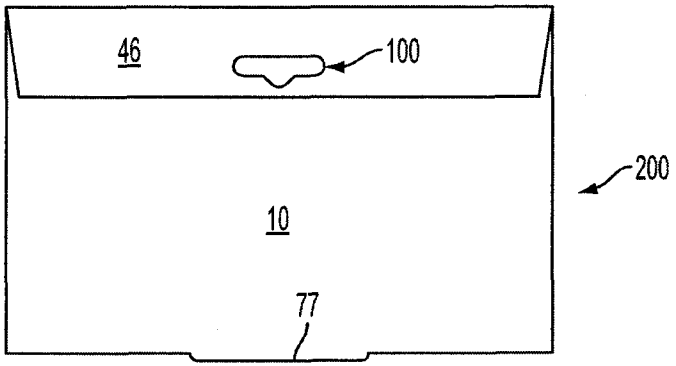
FIG. 3 is a rear view of the carton of FIG. 2.
Figure 5:
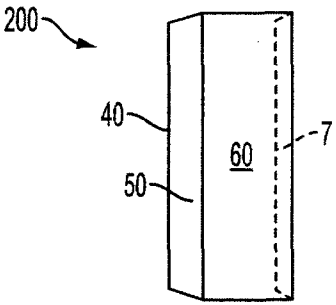
FIG. 5 is a left side view of the carton of FIG. 2.

Referring in particular to FIGS. 2, 4, and 5, to erect the carton 200, panels 30, 50 may be folded along the fold lines 31, 41, respectively, so as to extend rearwardly from panel 40 at an obtuse angle. As best shown in FIG. 6, panels 20, 60 may be folded along the fold lines 11, 21, 51 so as to extend substantially parallel to each other and substantially perpendicularly to the front panel 40. Referring to FIG. 3, panel 10 may be folded along the fold line 11 such that panel 10 extends substantially parallel to panel 40. Referring to FIG. 5, the adhesive panel 7 may be folded along fold line 9 such that adhesive panel 7 extends substantially parallel to the second side panel 60. Adhesive panel 7 may be attached to the inner or outer side of panel 60 by adhesive or other suitable attachment means.

Figure 7:
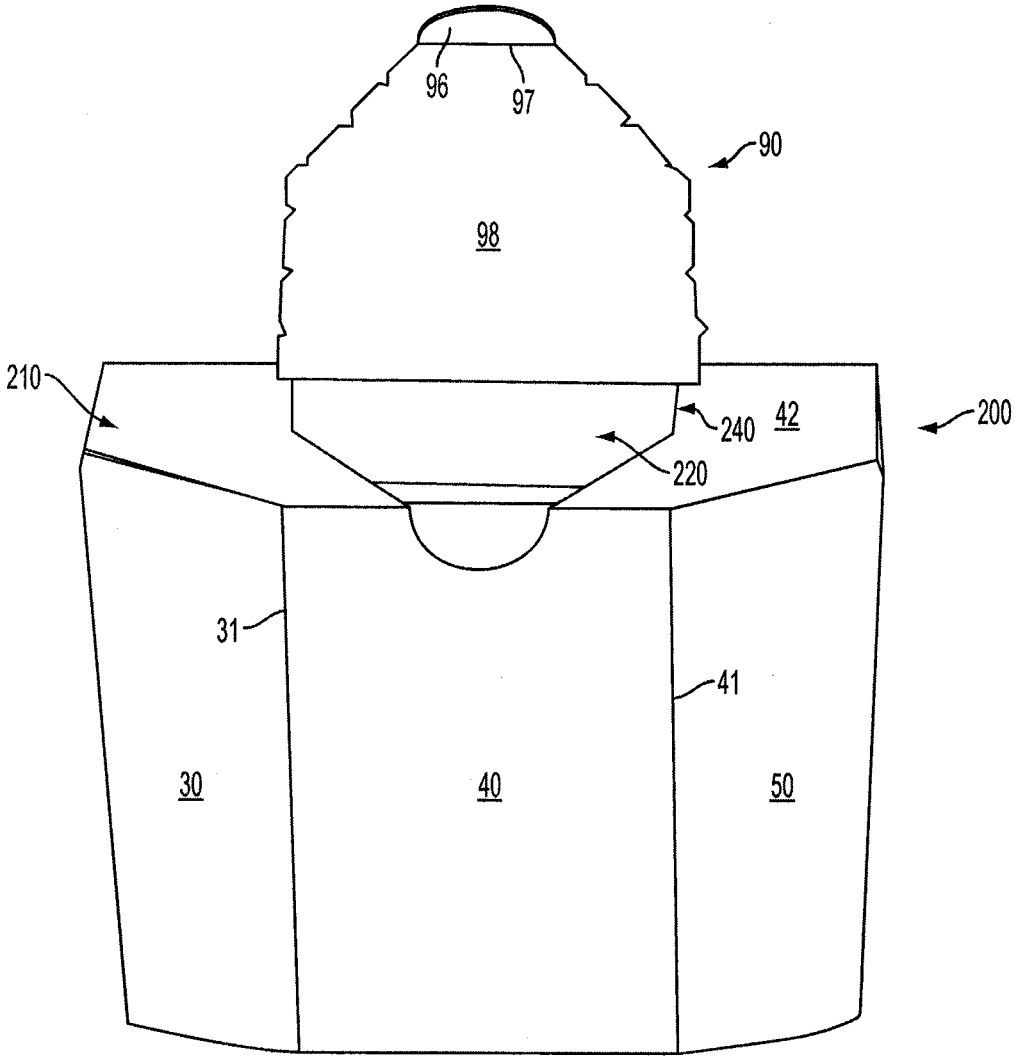
FIG. 7 shows the carton of FIG. 2 in an open configuration.

End flaps 22, 62 may be folded inwardly towards the interior of the carton 200 (not shown) so as to extend transversely to the first and second side panels 20, 60, respectively. As shown in FIG. 2, flap 12 may be folded inwardly along the fold line 13 so as to extend substantially perpendicularly to panel 10 and panel 40, between panel 10, panel 40, panels 20, 60 and panels 30, 50. Tuck-in flaps 16, 26 may be folded downwardly along fold lines 17, 27 so as to extend substantially parallel to the second and first side corner panels 50, 30, respectively. Reinforcement flaps 16, 26, 18, and/or 28 may abut and may be adhered to the interior surface of panels 50, 30, respectively (not shown). End flap 42 also may be folded downwardly over end flap 12 along fold line 43 such that end flap 42 extends substantially parallel to end flap 12 and overlaps end flap 12, with dispensing feature 90 aligned over opening 80. End flaps 12, 42 may be adhesively or otherwise attached to each other, thereby forming a top end panel 210 (FIG. 7) of the carton 200. End flaps 22, 62 (FIG. 1) may also be adhered to the interior surface of the top end panel 210 (FIG. 7).

Referring to FIG. 3, the hanging flap 46 optionally may be folded downwardly along fold line 47 so as to extend substantially parallel to panel 10 in carton 200. The hanging flap 46 may optionally be releasably adhesively attached to panel 10.

As shown in the cut-away sections in FIG. 6, end flaps 24, 64 may be folded inwardly towards the interior of the carton 200 so as to extend transversely to panels 20, 60, respectively. Still referring to FIG. 6, end flap 14 may be folded inwardly along fold line 15 so as to extend substantially perpendicularly to panel 10 and panel 40, between panel 10, panel 40, panels 20, 60, and panels 30, 50. Tuck-in flaps 18, 28 may be folded upwardly along fold lines 19, 29 so as to extend substantially parallel to panels 50, 30, respectively. For reinforcement, tuck-in flaps 18, 28 may abut and may be adhered to the interior surface of panels 50, 30, respectively (not shown). Additionally, end flap 44 may be folded downwardly over end flap 14 along fold line 45 such that end flap 44 extends substantially parallel to end flap 14 between panel 10, panel 40, panels 20, 60, and panels 30, 50. End flap 44 thereby overlaps end flap 14. End flaps 14, 44 may be adhesively or otherwise attached to each other, thereby forming a bottom end panel 230 (FIG. 6) of the carton 200. End flaps 24, 64 (FIG. 1) may also be adhered to the interior surface of the bottom end panel 230.

The steps in the above-described process are not limited to the sequence in which they are described, and may be performed in a number of different sequences. Prior to closing the one or more of the top end panel 210 (FIG. 7), panel 60 and panel 7, and the bottom end panel 230 (FIG. 6) (such that an opening remains in the structure formed by the blank 5 (FIG. 1) to allow access to the interior of the structure) the interior of the folded blank 5 may be loaded with desired contents or articles.

The carton 200 formed by the exemplary process provided above therefore includes: panel 10 (FIG. 1) and panel 40 extending substantially parallel to each other; panels 20, 60 extending substantially parallel to each other from opposite side edges of panel 40, and substantially perpendicularly to panels 40, 10; panels 30, 50 extending at obtuse angles from opposite side edges of panel 40 to panels 20, 60, respectively; the top end panel 210 extending between panel 10, panel 40, panels 20, 60, and panels 30, 50; and the bottom end panel 230 (FIG. 6) extending substantially parallel to the top end panel 210 (FIG. 7) between panel 10 (FIG. 1), panel 40, panels 20, 60, and panels 30, 50. The projection 77 in panel 10 forms a support, stand, or the like, for helping to stabilize the carton on an underlying support surface.

When the carton 200 is in a closed configuration, such as shown in FIGS. 2-6, a top opener, or lid is formed in top end panel 210 and panel 40. The opener includes the at least partially detachable dispensing panel 98 in panel 42 and the at least partially detachable tab 96 in panel 40.

FIG. 7 shows the carton 200 in a configuration for dispensing contents or articles from the carton 200. As shown in FIG. 7, the tab 96 is detached from panel 40 and dispensing panel 98 is partially detached from end flap 42, such that the lid is partially detached from the top panel 210, and thereby forms an opening 220 in end flap 42 that is at least partially aligned with opening 84 in end flap 12. This separation may be accomplished by detaching or tearing tab 96 from panel 40 along tear line 93 (which detaching can include pushing tear tab 96 at least partially into the interior of the carton, or pulling tear tab 96 to separate the tab 96 from panel 40 along tear line 93), and then pulling the tab 96 to separate or tear dispensing panel 98 away from end flap 42 along tear lines 91, 92, 94, 95. The openings 84, 220 form a dispenser 240 through which contents or articles can be removed from or placed inside the carton 200. The lid may be opened to facilitate access to the dispenser 240 by folding the lid upwardly and rearward along fold line 47. The lid may be reclosed or substantially reclosed to cover the dispenser 240 by folding the lid downwardly and forwardly along the fold line 47.

Figure 8:
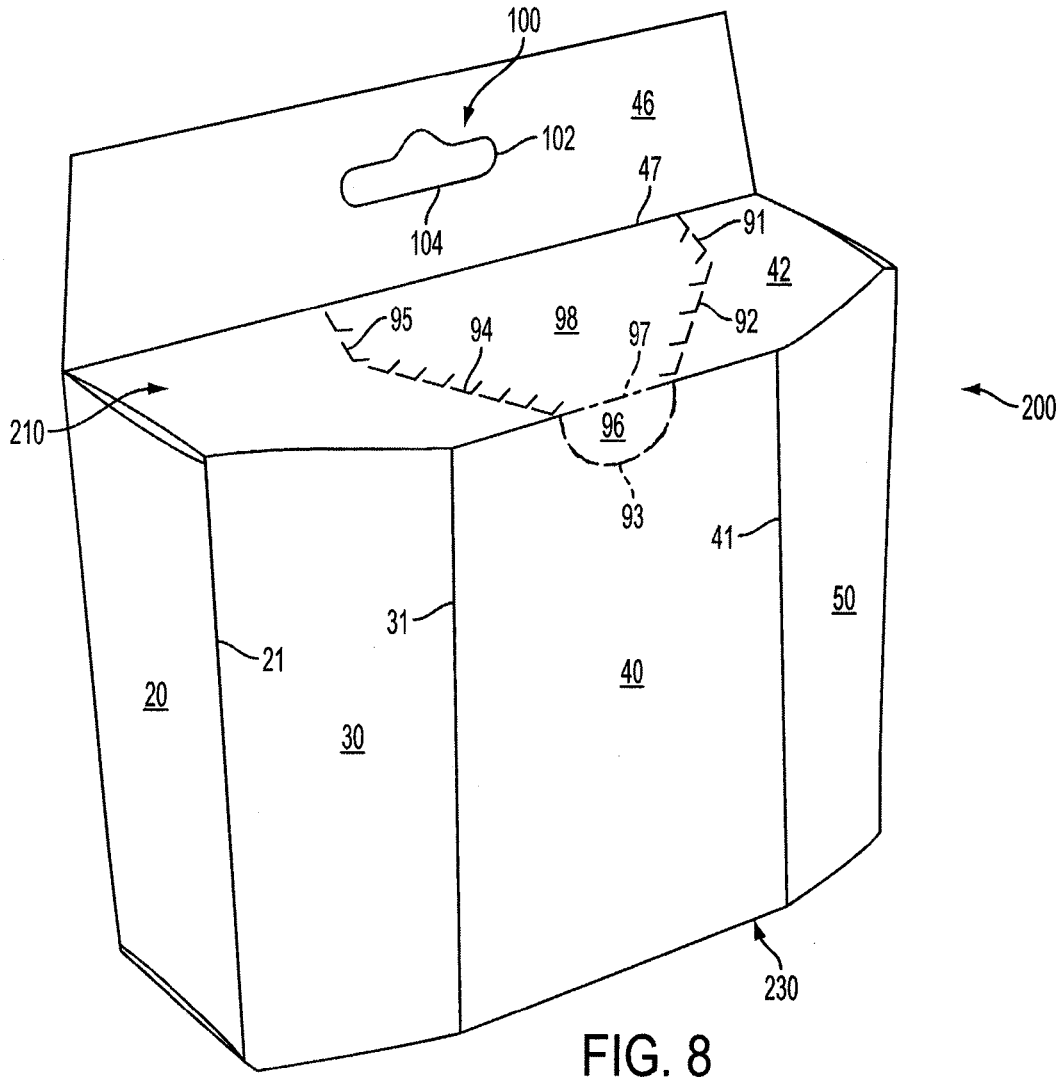
FIG. 8 shows the carton of FIG. 2 in a hanging configuration.

FIG. 8 shows the carton 200 in a configuration for hanging the carton 200 from a wall or other structure. This configuration is similar to the configuration shown in FIGS. 2-6, except that the hanging panel 46 is folded along the rear edge of the top end panel 210 (formed by fold line 47) so as to extend upwardly, substantially parallel to panel 10. Thus, a hanging element (e.g., screw, nail, pin, or hook) attached to a support wall or other structure may be inserted through opening 104 in the hanging panel 46 such that the carton 200 is hanged from the support wall or other structure. In embodiments in which the hanging panel 46 is initially releasably attached to panel 10 (e.g., via an adhesive material), the hanging panel 46 may be separated from panel 10, and thereafter folded upwardly along the rear edge of top end panel 210 into configuration for hanging.

The blank and carton formed can be of any dimensions, which dimensions can be modified to receive, transport, and/or dispense different contents. For exemplary purposes only, the following dimensioning is provided for a blank that forms a carton. In the example embodiment, the blank can be approximately 8 to 10 inches in width (as measured from end flap 44 to hanging flap 46) and approximately 12 to 14 inches in length (as measured from panel 7 to panel 60), with the exemplary carton having a width of 9.7408 inches and a length of 13 and 41/64 inches. The exemplary blank has a length of panel 7 of 5/8-inch, a length of panel 10 of 5-inches, a length of panel 20 of 1 1/2 inches, a length of panel 30 of 125/64 inches, a length of panel 40 of 2 1/4 inches, a length of panel 50 of 125/64 inches, and a length of panel 60 of 131/64 inches. The exemplary blank has a width of hanging flap 46 of 1 1/4 inches, a width of end flap 42 of 2.0817-inches, a width of panels 10, 20, 40, and 60 of 315/16 inches, and a width of end flap 44 of 1.9567 inches. A carton formed from this exemplary blank has an approximate size of 5 by 1 1/2 by 5 inches, has an approximate area of 100.95 inches, and has an approximate rule length of 141.433 inches. These dimensions are offered for exemplary purposes only and should not limit in any manner the scope of the invention or the claims.

In some instances in the foregoing, attaching parts together is described with reference to specific features and methods. However, the attaching may be carried out in any suitable manner, such as, but not limited to, through the use of adhesive material.

The term "fold line" is used throughout the description. It is noted that, unless stated otherwise, the term "fold line" can include any at least somewhat line-like arranged, although not necessarily straight, form of weakening in the blank that facilitates folding therealong. More specifically, but not for the purpose of narrowing the scope of the present invention, conventional fold lines can include: a crease, such as formed by folding; a score line, such as formed with a blunt scoring knife, or the like, which creates a crushed portion in the material along the desired line of weakness; a slit that extends partially into the material along the desired line of weakness, and/or a series of spaced apart slits that extend partially into and/or completely through the material along the desired line of weakness; or various combinations of these features. The term "tear line" is also used throughout the specification. A tear line can be any at least somewhat line-like arranged, although not necessarily straight, form of weakening that facilitates tearing therealong. More specifically, but not for the purpose of narrowing the scope of the present invention, conventional tear lines include a slit that extends partially into the material along the desired line of weakness, a series of spaced apart slits that extend partially into and/or completely through the material along the desired line of weakness, or any combination of these features.

As an example, a tear line can include: a slit that extends partially into the material along the desired line of weakness, and/or a series of spaced apart slits that extend partially into and/or completely through the material along the desired line of weakness, or various combinations of these features. As a more specific example, one type tear line is in the form of a series of spaced apart slits that extend completely through the material, with adjacent slits being spaced apart slightly so that a nick (e.g., a small somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous cut line. That is, it is within the scope of the present disclosure for each of the tear lines to be replaced with a continuous slit, or the like. For example, a cut line can be a continuous slit or could be wider than a slit without departing from the present disclosure.

The blanks according to the present disclosure can be formed, for example, from coated paperboard and similar materials. For example, the interior and/or exterior sides of the blanks can be coated with a clay coating. The clay coating then may be printed over with product, advertising, price coding, and other information or images. The blanks may then be coated with a varnish to protect any information printed on the blank. The blanks may also be coated with, for example, a moisture barrier layer, on either or both sides of the blank. In accordance with the above-described embodiments, the blanks may be constructed of paperboard of a caliper such that it is heavier and more rigid than ordinary paper. The blanks can also be constructed of other materials, such as cardboard, hard paper, or any other material having properties suitable for enabling the carton to function at least generally as described herein. The blanks can also be laminated or coated with one or more sheet-like materials at selected panels or panel sections.

The above embodiments also may be described as having a liner attached to the carton and/or one or more carton panels adhered together by glue during erection. The term "glue" is intended to encompass all manner of adhesives commonly used to secure carton panels or flaps in place.

The foregoing description of the disclosure illustrates and describes various exemplary embodiments. Various additions, modifications, changes, etc. could be made to the exemplary embodiments without departing from the spirit and scope of the claims. It is intended that all matter contained in the above description or shown in the accompanying drawings shall be interpreted as illustrative and not in a limiting sense. Additionally, the disclosure shows and describes only selected embodiments of the disclosure, but the disclosure is capable of use in various other combinations, modifications, and environments and is capable of changes or modifications within the scope of the inventive concept as expressed herein, commensurate with the above teachings, and/or within the skill or knowledge of the relevant art. Furthermore, certain features and characteristics of each embodiment may be selectively interchanged and applied to other illustrated and non-illustrated embodiments of the disclosure.

What is claimed is:

1. A blank comprising:

a first side panel connected along a first fold line to a second side panel;

the second side panel connected along a second fold line to a third side panel;

the third side panel connected along a third fold line to a fourth side panel;

the fourth side panel connected along a fourth fold line to a fifth side panel;

the fifth side panel connected along a fifth fold line to a sixth side panel;

end flaps connected along a first transverse fold line to a first end of the blank and along a second transverse fold line to a second end of the blank;

the end flaps including a first end flap connected along the first transverse fold line and a second end flap connected along the first transverse fold line;

the first end flap including a tear line pattern that at least partially defines a dispenser, the tear line pattern extends across the first transverse fold line, and a hanging end flap connected along a hanging fold line to the first end flap; and, the second end flap including an opening sized to dispense contents of a carton formed from the blank; the opening being spaced from the first transverse fold line;

wherein the first end flap overlaps the second end flap with the dispenser overlapping the opening in the carton formed from the blank; and wherein the hanging end flap includes a hook opening and the hook opening can be used to hang the carton formed from the blank from the hanging end flap.

2. The blank of claim 1 wherein the dispensing end flap is connected along the first transverse fold line to the third side panel.

3. The blank of claim 1 wherein the tear line pattern extends into the third side panel.

4. The blank of claim 3 wherein the tear line pattern is substantially continuous and the dispenser includes sections of the third side panel and of the first end flap.

5. The blank of claim 1 wherein the tear line pattern forms a tear tab in the third side panel.

6. The blank of claim 1 wherein the second end flap is connected along the first transverse fold line to the sixth side panel.

7. The blank of claim 1 further comprising a projection adjacent the second transverse fold line, wherein the projection is configured to form a stand to support the carton formed from the blank in an upright configuration.

8. A blank comprising:

a first side panel connected along a first fold line to a second side panel;

the second side panel connected along a second fold line to a third side panel;

the third side panel connected along a third fold line to a fourth side panel;

the fourth side panel connected along a fourth fold line to a fifth side panel;

the fifth side panel connected along a fifth fold line to a sixth side panel;

end flaps connected along a first transverse fold line to a first end of the blank and along a second transverse fold line to a second end of the blank;

the end flaps including a first end flap connected along the first transverse fold line, a second end flap connected along the first transverse fold line, and a hanging end flap connected along a hanging fold line to the first end flap;

the first end flap including a tear line pattern that at least partially defines a dispenser, the tear line pattern extends across the first transverse fold line; and, the second end flap including an opening;

wherein the first end flap overlaps the second end flap with the dispenser overlapping the opening in a carton formed from the blank;

wherein a third end flap is attached along the first transverse fold line to the first side panel and wherein a fourth end flap is attached along the first transverse fold line to the fifth side panel; and wherein the hanging end flap includes a hook opening and the hook opening can be used to hang the carton formed from the blank from the hanging end flap.

9. The blank of claim 8 wherein the end flaps include a fifth end flap connected along the second transverse fold line to the first side panel, a sixth end flap connected along the second transverse fold line to the third side panel, a seventh end flap connected along the second transverse fold line to the fifth side panel, an eighth end flap connected along the second transverse fold line to the sixth side panel.

10. The blank of claim 9 wherein the second end flap includes at least one tuck-in flap capable of securing the second end flap in place in the carton formed from the blank.

11. A carton comprising:

a first side panel connected along a first fold line to a second side panel;

the second side panel connected along a second fold line to a third side panel;

the third side panel connected along a third fold line to a fourth side panel;

the fourth side panel connected along a fourth fold line to a fifth side panel;

the fifth side panel connected along a fifth fold line to a sixth side panel;

a first end panel connected at a first end of the first side panel, the second side panel, the third side panel, the fourth side panel, the fifth side panel, and the sixth side panel;

a second end panel connected at a second end of the first side panel, the second side panel, the third side panel, the fourth side panel, the fifth side panel, and the sixth side panel;

a hanging flap connected along a hanging fold line to the first end panel;

a tear line pattern that at least partially defines a dispensing flap, the tear line pattern extends from the first end panel into the third side panel; and, an end flap connected to the sixth side panel, the end flap disposed under the dispensing flap in the carton, the end flap including an opening sized to dispense contents of the carton; the opening being spaced from the sixth side panel;

wherein the dispensing flap is detachable along the tear line pattern and is capable of being hinged about a hanging fold line to allow contents to be dispensed through the opening from the carton; and wherein the hanging flap includes a hook opening and wherein the hook opening can be used to hang the carton from the hanging flap.

12. The carton of claim 11 wherein the hanging flap is capable of being hinged about the hanging fold line to be disposed approximately perpendicular the first end panel.

13. The carton of claim 11 further comprising a projection at the second end, wherein the projection is configured to form a stand to support the carton in an upright configuration.

14. A method of forming a dispensing carton comprising:

providing a carton that comprises:

a first side panel connected along a first fold line to a second side panel;

the second side panel connected along a second fold line to a third side panel;

the third side panel connected along a third fold line to a fourth side panel;

the fourth side panel connected along a fourth fold line to a fifth side panel;

the fifth side panel connected along a fifth fold line to a sixth side panel;

a first end panel connected at a first end of the first side panel, the second side panel, the third side panel, the fourth side panel, the fifth side panel, and the sixth side panel;

a second end panel connected at a second end of the first side panel, the second side panel, the third side panel, the fourth side panel, the fifth side panel, and the sixth side panel;

a hanging flap connected along a hanging fold line to the first end panel;

a tear line pattern at least partially defining a dispensing flap, the tear line pattern extending from the first end panel into the third side panel;

an end flap connected to the sixth side panel, the end flap disposed under the dispensing flap in the carton, and including an opening sized to dispense contents of the carton; the opening being spaced from the sixth side panel;

wherein the dispensing flap is detachable along the tear line pattern and is capable of being hinged about a hanging fold line to enable contents of the carton to be dispensed through the opening from the carton; and wherein the hanging flap includes a hook opening and wherein the hook opening can be used to hang the carton from the hanging flap;

separating the dispensing flap from a remainder portion of the carton by tearing along the tear line pattern to reveal the opening in the end flap; and, dispensing contents from the carton through the opening of the end flap.

15. The method of claim 14 wherein separating the dispensing flap along the tear line pattern is initiated by engaging a tear tab along the tear line pattern.

16. The method of claim 15 wherein the tear tab is disposed in the third side panel.

17. The method of claim 14 wherein separating the dispensing flap along the tear line pattern includes hinging the dispensing flap along the hanging fold line in a first direction to expose the opening.

18. The method of claim 17 further comprising:

hinging the dispensing flap to close the carton after dispensing.

19. The method of claim 14 further comprising:

hinging the hanging flap about the hanging fold line to dispose the hanging flap approximately perpendicular the first end panel.

20. The method of claim 14 further comprising a projection at the second end, wherein the projection is configured to form a stand to support the carton in an upright configuration.

21. A blank comprising:

a first side panel connected along a first fold line to a second side panel;

the second side panel connected along a second fold line to a third side panel;

the third side panel connected along a third fold line to a fourth side panel;

the fourth side panel connected along a fourth fold line to a fifth side panel;

the fifth side panel connected along a fifth fold line to a sixth side panel;

end flaps connected along a first transverse fold line to a first end of the blank and along a second transverse fold line to a second end of the blank;

the end flaps including a first end flap connected along the first transverse fold line and a second end flap connected along the first transverse fold line, and a hanging end flap connected along a hanging fold line to the first end flap;

the first end flap including a tear line pattern that at least partially defines a dispenser, the tear line pattern extending across the first transverse fold line; and, the second end flap including a plurality of outer edges and an opening sized to dispense contents of a carton formed from the blank; the opening being spaced from the plurality of outer edges and the first transverse fold line;

wherein the first end flap overlaps the second end flap with at least a portion of the dispenser being disposed over the opening in the carton formed from the blank;

wherein the hanging end flap includes a hook opening and the hook opening can be used to hang the carton from the hanging end flap.

22. The blank of claim 21 wherein the second end flap is connected along the first transverse fold line to the third side panel.

23. The blank of claim 21 wherein the tear line pattern extends into the third side panel.

24. The blank of claim 23 further including a tear tab in the third side panel.

25. A carton comprising:

a first side panel connected along a first fold line to a second side panel;

the second side panel connected along a second fold line to a third side panel;

the third side panel connected along a third fold line to a fourth side panel;

the fourth side panel connected along a fourth fold line to a fifth side panel;

the fifth side panel connected along a fifth fold line to a sixth side panel;

a first end panel connected at a first end of the first side panel, the second side panel, the third side panel, the fourth side panel, the fifth side panel, and the sixth side panel;

a second end panel connected at a second end of the first side panel, the second side panel, the third side panel, the fourth side panel, the fifth side panel, and the sixth side panel;

a tear line pattern in the first end panel and the first side panel, the tear line defining at least a portion of a dispensing flap;

an end flap connected to the sixth side panel, the end flap disposed under the dispensing flap in the carton, the end flap including an opening sized to dispense contents of the carton; the opening being spaced from each of the first side panel, the second side panel, the third side panel, the fourth side panel, the fifth side panel, and the sixth side panel; and a hanging end flap foldably connected to the carton along a hanging fold line, wherein the hanging end flap includes a hook opening and the hook opening can be used to hang the carton from the hanging end flap.

26. The carton of claim 25 wherein the hanging end flap is connected along the hanging fold line to the first end panel.

27. The carton of claim 26 wherein the hanging flap is capable of being hinged about the hanging fold line to be disposed approximately perpendicular the first end panel.

* * * * *